US006114643A

United States Patent [19]

Marchini et al.

[11] Patent Number: 6,114,643

[45] Date of Patent: Sep. 5, 2000

[54] FLEXIBLE INTERFERENCE MOUNTING FLOATING ACTUATOR SWITCH ASSEMBLY

[75] Inventors: Michael G. Marchini; Richard L. Frost, both of Freeport, Ill.

[73] Assignee: Honeywell International Inc., Morristown, N.J.

[21] Appl. No.: 09/217,278

[22] Filed: Dec. 21, 1998

Related U.S. Application Data

[60] Provisional application No. 60/068,756, Dec. 23, 1997.

[51] Int. Cl.[7] ..... H01H 3/60

[52] U.S. Cl. ..... 200/295; 200/301

[58] Field of Search ..... 200/295, 301, 200/330, 332.1, 341

[56] References Cited

U.S. PATENT DOCUMENTS

| | | | |
|---|---|---|---|
| 3,215,807 | 11/1965 | Spitler | 200/301 X |
| 4,703,161 | 10/1987 | McLean | 200/301 X |
| 5,193,664 | 3/1993 | Ives | 200/295 X |

*Primary Examiner*—Renee Luebke

*Attorney, Agent, or Firm*—Roland W. Norris; Kris T. Fredrick; Andrew A. Abeyta

[57] ABSTRACT

A switch assembly with three axis actuator tolerance comprises a body containing an actuator floating in the x-y plane for moving a camming device which activates a self-contained switch unit with all parts being contained within the body. The switch assembly is thereby highly useful for accommodating manufacturing tolerances of appliances where the switch actuator must fit through holes in appliance panels or the body must fit between appliance panels or both.

9 Claims, 2 Drawing Sheets

FLEXIBLE INTERFERENCE MOUNTING FLOATING ACTUATOR SWITCH ASSEMBLY

This application claims the benefit of prior filed provisional application 60/068,756 Dec. 12, 1997

BACKGROUND OF THE INVENTION

1. Field of the Invention

This invention relates generally to switch casings and more particularly to a switch casing which allows the switch actuator to be variably positionable, or float, in three axes.

2. Description of the Prior Art

In the assembly of appliances such as washing machines, clothes dryers, or the like there are often switches which control mechanisms dependent upon the position of a door. For example, when a dryer door is opened a switch opens to stop the drum from turning. The actuators for such switches often extends through a hole in an exterior or exposable panel of the appliance, while the body of the switch containing the electrical contacts is mounted within the body of the appliance.

In order to make economical use of a common switch design, a basic self-contained switch apparatus is adapted to a variety of end uses by placing it in a variety of bodies designed for specific applications. The aforementioned dryer may have a unique body and actuator assembly containing the basic switch, while a refrigerator may have a different and unique body and actuator assembly for its purpose but containing the same basic switch.

Often these switch assemblies must fit between two panels, a structural, or internal panel, and a facing, or external, panel which the consumer will see and through which the switch actuator must communicate between the appliance exterior and the basic switch apparatus.

In the past, as seen in FIG. 1, appliance manufacturers have located the switch assembly on the interior of the external panel due to manufacturing tolerance limitations of panel hole placement and panel-to-panel spacing so that the actuator is properly placed in relation to the hole. However, this placement often results in complications with assembly of the appliance, such as placement of the mounting hardware, and later disassembly of the outer panel from the appliance.

It would be preferable, from a manufacturing view point, to mount the switch assembly onto the interior panel of the appliance, as seen in FIG. 2, and merely place the exterior panel, with the panel hole over the switch assembly, thus obviating the difficulties involved in locating the switch assembly on the exterior panel.

SUMMARY OF THE INVENTION

It is an object of the present invention to obviate the difficulties of panel hole placement over a switch actuator by accommodating, within the switch assembly, manufacturing tolerances of hole placement and panel alignment.

Towards this end a switch assembly containing the basic switch has an actuator means for the basic switch apparatus floating in the x and y plane normal to the actuator movement. The assembly further has a body compressible in the z-axis, i.e. parallel to or on axis with, the actuator travel. Both the floating actuator and the compressible body will accommodate the manufacturing tolerances and allow for desired placement of the switch on the interior panel of the appliance.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
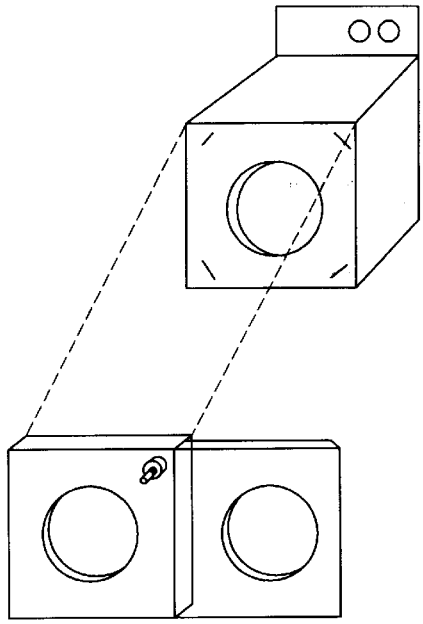
Fig.1 (PRIOR ART)
FIG. 1 is an illustration of known appliance switch arrangement.
Figure 2:
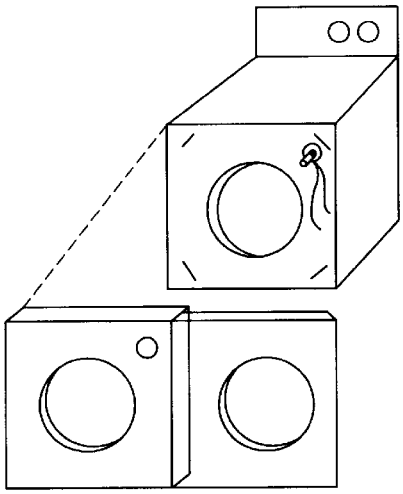
FIG. 2 illustrates appliance switch placement with the present invention.

Throughout the Description of the Preferred Embodiment, like components will be identified by like reference numerals.

Figure 3:
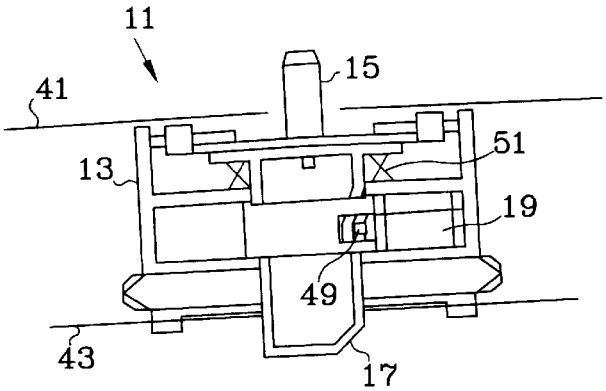
FIG. 3 is a side view of a switch assembly of the present invention.
Figure 4:
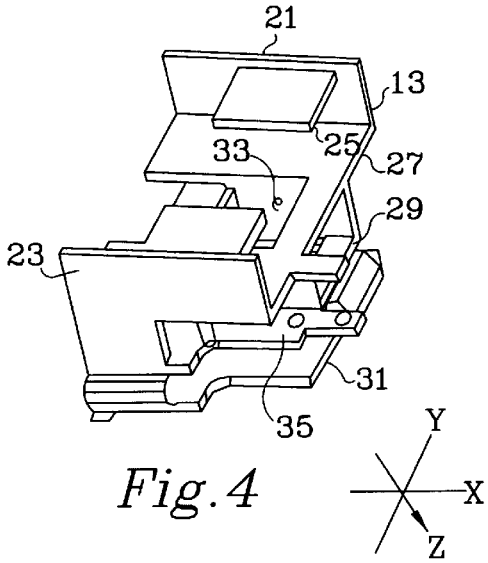
FIG. 4 is a top perspective of the body portion of the switch assembly.
Figure 5:
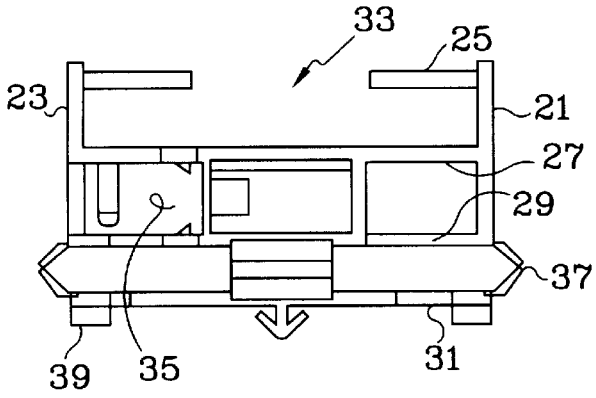
FIG. 5 is a side view of the body portion of the switch assembly.

As seen in FIG. 3, a switch assembly 11 comprises a body 13, an actuator 15, a cam 17, and a switch 19. The body 13, or base, is preferably composed of plastic and is constructed and arranged to contain the actuator 15 and cam 17 parts as well as the self-contained switch 19. As best seen in FIGS. 4 and 5, the body 13 has two vertical side walls 21, 23 with four horizontal walls 25, 27, 29, 31 having varying degrees of openness and compartmentalization to accommodate the actuator and cam. A central channel 33 allows the cam to pass vertically through the body 13. The top or first horizontal wall 25 is essentially two opposing wings for limiting the x-axis float of the actuator 15. The axes are arbitrarily defined and shown in FIG. 4, with x and y axes defining the plane of the actuator float, and z being the direction of cam travel. The second and third horizontal walls 27 and 29 define therebetween a switch chamber 35 for holding the self-contained switch 19. The third horizontal wall 29 and fourth, or bottom, horizontal wall 31 are hinged together by flexible side members 37. If the switch assembly 11 is compressed between two appliance panels 41, 43 third and fourth walls 29, 31 will move towards each other thus accommodating greater manufacturing tolerance in the spacing between appliance panels. The bottom wall 31 may be equipped with clips 39 or the like to help in securing the body 13 to the appliance structure.

Figure 6:
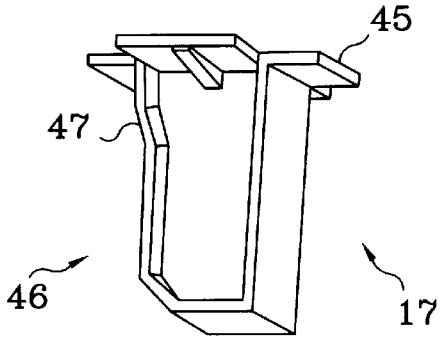
FIG. 6 is a bottom perspective view of the cam portion of the switch assembly.

As best seen in FIG. 6, the cam 17 has a cruciform platform top 45 having its major surface extending in the x-y plane for abutting the actuator when placed in the switch assembly. Depending from the platform top 45 are vertical walls forming a box 46 of irregular polygonal cross section containing the camming surface 47. Camming surface 47 abuts the on/off button 49 of the self contained switch 19 when operatively placed in the switch assembly 11 (FIG. 3). The angle of the camming surface 47 with respect to the axis of travel of the on/off button 49 of the switch 19 will determine the actuation distance of the device and may be adjusted accordingly. A conical coil spring 51 (FIG. 3) compressible to the diameter of its wire is preferably used to bias the cam upwardly towards the actuator 15, although other suitable means may be employed. The cam is shown as extending below the bottom wall 31 of the body 13, in which case it would extend through an opening in the appliance panel 43, but it will be evident to those of ordinary skill that the cam may be designed to fit entirely within the body.

Figure 7:
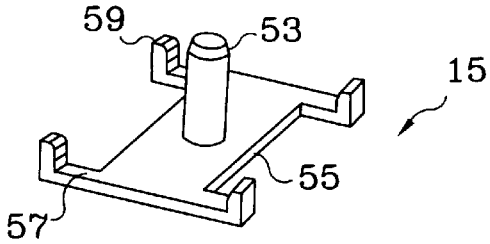
FIG. 7 is a top perspective view of the actuator portion of the switch assembly.
Figure 8:
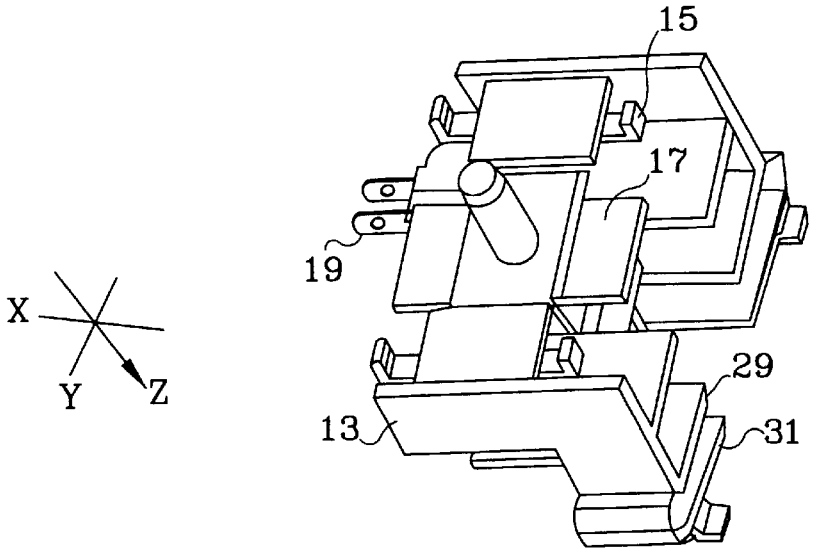
FIG. 8 is a top perspective view of the switch assembly of the preferred embodiment.

As shown in FIG. 7, the actuator 15 comprises a rod-like plunger 53 attached to and extending perpendicularly from a rectangular bed portion 55 for operatively interfacing with the cam platform 45. At each corner of the bed portion 55 is an outrigger 57 having an upright 59. The uprights 59 surround each half of the first horizontal wall 25 of the body 13 and extend therebeyond to establish the amount of x-axis float. The y-axis float is determined by the dimension of the bed 55 rectangle shortfall in fitting between the body vertical side walls 21, 23. The perspective view of FIG. 8 perhaps best illustrates the floating nature of the actuator 15 in the x-y plane resting atop the cam 17, with the cam 17 and self-contained switch 19 being encompassed within the body 13 whose lower horizontal walls 29, 31 are flexibly hinged to be compressible in the z-axis.

While the present invention has been shown and described with reference to preferred embodiments, many alternatives will become apparent to the ordinarily skilled artisan upon disclosure of the present invention. Therefore the present invention is only to be limited by the claims appended hereto.

Having thus described the invention what is claimed is:

1. A switch assembly comprising:

a) a body compressible in a z-axis having a cam fitting space for containing a cam and an actuator therein, b) a cam having a top surface and a camming surface for contacting an on/off button of a switch, the camming surface extending through the cam fitting space of the body generally in the z-axis; and c) an actuator constructed and arranged to float in the x-axis and the y-axis between within the body, the actuator being adjacent the cam so as to activate the camming surface when force is applied to the actuator.

2. A switch assembly comprising:

a) a body compressible in a z-axis having:

a space for fitting a cam therein, a space for fitting a switch therein, the switch space constructed and arranged so as to allow placement of an on/off button of the switch in opposition to a camming surface of a cam, a pair of opposing horizontal walls extending generally in the y-axis and spaced apart to allow the cam therethrough, vertical walls attached to and supporting said horizontal walls;

b) a cam having a top surface and a camming surface for contacting the on/off button of the switch, the camming surface extending through the cam fitting space of the body generally the z-axis; and c) an actuator having a plunger extending in the z-axis and having a bed, the bed having outriggers constructed and arranged to extend beyond the body horizontal walls to allow actuator travel in the x-axis and having uprights extending in the z-axis to limit travel of the actuator in the x-axis, the bed being shorter in length than the distance between the vertical side walls of the body so as to allow actuator travel in the y-axis between the vertical walls, the bed being adjacent the cam top surface such that the camming surface touches against the on/off button when force is applied to the plunger.

3. A switch assembly comprising:

a) a body having a portion compressible along a z-axis, a space for fitting a cam therein, a space for fitting a switch therein, constructed and arranged so as to place an on/off button of the switch in opposition to a camming surface of the cam, horizontal walls extending in a y-axis and spaced apart to allow the cam therethrough, vertical walls attached to and supporting said horizontal walls;

b) a cam having a top surface generally lying in the x-y plane and a camming surface for contacting the on/off button of a switch, the camming surface extending through the cam fitting space of the body in the z-axis; and c) an actuator having a plunger extending above the body in the z-axis, the plunger extending from a bed, the bed having outriggers constructed and arranged to extend beyond the body horizontal walls to allow actuator travel in the x-axis and having uprights extending in the z-axis to limit travel of the actuator in the x-axis, the bed being shorter in length than the distance between the vertical side walls of the body so as to allow actuator travel in the y-axis between the vertical walls, the bed being adjacent the cam top surface such that the camming surface touches against the on/off button when force is applied to the plunger.

4. The switch assembly according to claim 3 further comprising:

a spring for biasing the cam toward the actuator.

5. The switch assembly according to claim 3 further comprising:

a switch mechanism located within the body space provided therefor.

6. The switch assembly according to claim 3 further comprising:

the top cam surface constructed and arranged to cover an area of the actuator travel in the x-axis and in the Y-axis.

7. The switch assembly according to claim 3 further comprising:

the actuator bed being constructed and arranged to cover the top cam surface in any position of its actuator travel in the x-axis and in the Y-axis.

8. The switch assembly according to claim 3 further comprising:

mounting means on the body for attachment to an external surface.

9. A switch assembly comprising:

a) a body having,

1st, 2nd and 3rd horizontal walls lying generally in an x-y plane and attached to rigid vertical walls extending in an x-z plane, a 4th horizontal wall in the xy plane, attached by a compressible vertical wall structure lying generally in the x-z plane and forming a compressible space in the a z-axis between the 3rd horizontal wall and 4th horizontal wall at least the 1st and 2nd horizontal walls having voids therein for fitting a cam therethrough extending generally in the z-axis, a space between the 2nd and 3rd horizontal walls for fitting a switch therein, constructed and arranged so as to place an on/off button of the switch in opposition to a camming surface of the cam;

b) a switch within the switch fitting space having an on/off button for actuating the switch;

c) a cam having a top surface generally lying in the x-y plane between the 1st and 2nd horizontal walls and having a camming surface for contacting the on/off button of a switch, the camming surface extending through the cam fitting space of the body in the z-axis; and d) an actuator having a plunger extending above the body in the z-axis, the plunger extending from a bed, the bed lying between the 1st and 2nd horizontal walls and having outriggers constructed and arranged to extend beyond the 1st horizontal wall to allow actuator travel in the x-axis and having uprights extending in the z-axis to limit travel of the actuator in the x-axis, the bed being shorter in length than the distance between the vertical side walls of the body so as to allow actuator travel in the y-axis between the vertical walls, the bed being adjacent the cam top surface such that the camming surface touches against the on/off button when force is applied to the plunger.

* * * * *